US010352609B2

(12) United States Patent
Kriesel

(10) Patent No.: US 10,352,609 B2
(45) Date of Patent: Jul. 16, 2019

(54) RETRACTABLE ICE COOLER

(71) Applicant: Roger Mark Kriesel, Ft. Worth, TX (US)

(72) Inventor: Roger Mark Kriesel, Ft. Worth, TX (US)

( * ) Notice: Subject to any disclaimer, the term of this patent is extended or adjusted under 35 U.S.C. 154(b) by 142 days.

(21) Appl. No.: 15/062,344

(22) Filed: Mar. 7, 2016

(65) Prior Publication Data

US 2017/0254578 A1 Sep. 7, 2017

(51) Int. Cl.
*F25D 3/08* (2006.01)
*F25D 27/00* (2006.01)

(52) U.S. Cl.
CPC ..... *F25D 3/08* (2013.01); *F25D 27/00* (2013.01); *F25D 2303/081* (2013.01); *F25D 2303/0844* (2013.01)

(58) Field of Classification Search
CPC ..... F25D 3/08; F25D 3/06; F25D 3/02; F25D 2303/081; F25D 2303/0844; F25D 2303/084; F25D 2323/061; F25D 23/02; F25D 23/021; F25D 23/023; F25D 23/025; F25D 23/026; F25D 23/028; F25D 23/067; B65D 25/06; B65D 25/04; B65D 25/16; A45C 11/20; Y10S 220/9151; Y10S 220/9152; A47F 3/043
USPC ..... 220/545, 544, 530, 529, 592.03, 915.2, 220/915.1; 160/319; 410/118, 119
See application file for complete search history.

(56) References Cited

U.S. PATENT DOCUMENTS 3,542,445 A * 11/1970 Donker ..... A47F 3/0469 312/116
4,697,380 A * 10/1987 Fenske ..... A01K 97/04 220/263
4,759,467 A 7/1988 Byrne
4,801,180 A * 1/1989 Styles ..... A47F 3/0469 312/116
4,964,528 A 10/1990 Wagoner
5,197,292 A * 3/1993 McPherson ..... F25D 3/08 62/56
5,269,156 A * 12/1993 van de Velde ..... F25D 3/08 62/371
5,295,365 A 3/1994 Redford
5,605,056 A 2/1997 Brown
(Continued)

OTHER PUBLICATIONS

Repair Guides—Exterior—Sunroof—AutoZone.com—Subaru Car May 1998. Accessed via web Apr. 5, 2018.*

*Primary Examiner* — Jianying C Atkisson
*Assistant Examiner* — Tavia Sullens

(57) ABSTRACT

One embodiment of an improved portable ice cooler that eases access to the cooled contents by integrating in a single apparatus an adjustable ice containment device, a front door, a window, internal lighting and a specialized external contour. The benefits these features provide are a significant reduction in the discomfort and difficulty currently encountered when placing, locating, and removing contents from a current state of the art ice cooler that is accessed from the top or front. The ice containment device further offers the capability of holding a desired level of retraction to the ice within the cooler. The provision for retraction of the ice and thereby the ability to adjust both the proximity of the ice to the items in the cooler as well as the weight of the ice upon those items can be utilized to cool fragile objects.

6 Claims, 6 Drawing Sheets

(56) References Cited

U.S. PATENT DOCUMENTS 5,632,520 A * 5/1997 Butz ..... B60R 5/006 410/118
5,671,611 A 9/1997 Quigley
5,772,370 A * 6/1998 Moore ..... B60R 7/005 410/118
5,845,515 A 12/1998 Nelson
6,349,559 B1 2/2002 Hasanovic
7,013,670 B2 3/2006 Gonzalez
7,100,397 B1 * 9/2006 Gratteau ..... F25D 3/08 62/457.5
7,722,204 B1 * 5/2010 Sandberg ..... F25D 3/08 362/155
7,819,451 B2 * 10/2010 Yoshida ..... B60R 7/02 410/118
8,065,889 B1 11/2011 Silberman
2003/0066252 A1 * 4/2003 Rejc ..... F25D 23/021 52/173.2
2006/0144077 A1 * 7/2006 Morris ..... F25D 3/08 62/459
2006/0242990 A1 * 11/2006 Kao ..... F25D 3/08 62/457.4
2006/0288730 A1 12/2006 Shill
2008/0302126 A1 * 12/2008 Falkenberg ..... F25D 3/08 62/457.1
2010/0287976 A1 11/2010 Roof
2012/0151944 A1 6/2012 Carlson
2012/0325826 A1 * 12/2012 McCormick ..... F25D 3/06 220/592.01
2013/0153584 A1 * 6/2013 Balleck ..... F25D 3/08 220/592.01
2013/0233741 A1 * 9/2013 Caruth ..... A61J 7/0084 206/232
2014/0208778 A1 * 7/2014 Raley ..... F25D 3/08 62/62
2014/0250926 A1 9/2014 Balleck
2014/0252009 A1 9/2014 Robinson

* cited by examiner

Retractable Ice Cooler
External View- Front

Retractable Ice Cooler
External View- Back

Retractable Ice Cooler
Ice Containment Assembly
Subassemblies

Retractable Ice Cooler
Ice Containment Assembly
Retracted

Retractable Ice Cooler
Unretracted Ice Containment Assembly
Side View Section

Retractable Ice Cooler
Retracted Ice Containment Assembly
Side View Section

RETRACTABLE ICE COOLER

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyrights whatsoever.

CROSS-REFERENCE TO RELATED APPLICATIONS

Not Applicable

FEDERALLY SPONSORED RESEARCH

Not applicable

BACKGROUND OF THE INVENTION

This apparatus is associated with the field of endeavor of ice-based portable coolers designed for the purpose of storage of perishable or otherwise heat-sensitive items. Its purpose is to improve the functionality of the cooler by: (1) faster and more comfortable access to the contents, (2) faster restocking, (3) reduced ice spillage, and (4) the provision of an adjustable mechanism to manipulate the proximity of the ice to the contents.

BACKGROUND OF THE INVENTION—PRIOR ART

Portable ice coolers for the temporary storage of perishable contents or temperature-sensitive items have existed for decades. The majority of commercialized designs in use today comprise a single molded enclosure constructed of a high R-value foam insulation that is encased within a high impact plastic. These coolers are almost exclusively top accessible and typically have one cover for access to the single enclosure. The refrigerated contents are usually placed in the bottom of the enclosure and the ice is poured on top. The ice encapsulates the contents, cooling them primarily by conduction.

The problem with the current state of the art is that the contents placed in the cooler are often difficult to access due to the qualities of the ice, specifically its considerable weight, freezing temperature, and tendency to refreeze into obstructive clumps. Accessing the cooled items is often time consuming, usually limited to a downward approach, and is uncomfortable due to the exposure of the user's hands to the hardness and extreme coldness of the ice. Additionally, the contents of an ice-filled cooler can be damaged and spilled as they are displaced while attempting to access a specific item, the location of which is often obscured by the overlying layer of ice.

The present state of the art typically utilizes a top-only entrance and a single enclosure for the ice and contents. The cooled items are commonly placed in the base of the cooler and the remaining volume is filled with ice to encapsulate them. To avoid the previously noted accessibility problems, cooled items are sometimes placed on top of the ice. This method of loading a cooler is also problematic since the items are then exposed to the warmer air above the ice layer. The result is a loss of good cooling performance for a gain of convenient access.

Advances in the prior art to improve accessibility to a coolers contents include: (1) multiple rigid or movable compartments, (2) inner and outer chambers, or essentially an enclosure in a cooler design, (3) multiple drawers, (4) invertible cooler designs, (5) shelves, and (6) vertically removable netting to separate the ice, melt water, or contents from one another.

The following table lists prior art that appears relevant:

COMPARABLE PRIOR ART

| Pat. No. | Publication Date | Inventor |
|---|---|---|
| US20130153584 A1 | 20 Jun. 2013 | Balleck |
| US20140250926 A1 | 11 Sep. 2014 | Balleck |
| U.S. Pat. No. 5,605,056 A | 25 Feb. 1997 | Brown and Starling |
| U.S. Pat. No. 4,759,467 A | 26 Jul. 1988 | Byrne |
| US20120151944 A1 | 21 Jun. 2013 | Carlson |
| U.S. Pat. No. 7,013,670 B2 | 21 Mar. 2006 | Gonzalez and Smith |
| U.S. Pat. No. 6,349,559 B1 | 26 Feb. 2002 | Hasanovic |
| U.S. Pat. No. 5,845,515 A | 8 Dec. 1998 | Nelson |
| U.S. Pat. No. 5,671,611 A | 30 Sep. 1997 | Quigley |
| U.S. Pat. No. 5,295,365 A | 22 Mar. 1994 | Redford |
| US20140252009 A1 | 11 Sep. 2014 | Robinson, Robinson and DeVries |
| US20100287976 A1 | 18 Nov. 2010 | Roof, Peters |
| US20060288730 A1 | 28 Dec. 2006 | Shill |
| U.S. Pat. No. 8,065,889 B1 | 29 Nov. 2011 | Silberman |
| U.S. Pat. No. 4,964,528 A | 23 Oct. 1990 | Wagoner |

Rigid and movable compartments are detailed by Roof and Peters. Their design segregates the ice and contents in order to overcome the accessibility challenge posed by traditional cooler designs; however, the problem that arises is a loss of usable space and a substantial reduction in the cooling efficiency. Adding walls to the inside the cooler consumes space and hinders the heat conduction essential to cool the contents. Additionally, movement of the walls to accommodate changes in the volume of ice and stored items is cumbersome.

Quigley details a rigid ice compartment surrounding a central storage chamber. Quigley achieves a high degree of accessibility by completely segregating the ice from the cooled items. Both the central storage compartment for items to be cooled and the ice compartment are each equipped with a dedicated door accessible from above. The cooling effectiveness achieved by Quigley's design, however, is suspect. A narrow coolant compartment, the absence of any provision for ice above or below the contents, and a solid barrier between the ice and the contents are significant departures from traditional cooler design. Each of these design elements impedes the cooling capacity of his design. Their cumulative effect likely renders his design ineffective for cooling items that are high in density or volume.

A double enclosure design is detailed by Hasanovic. His design overcomes the accessibility challenge, but decreases cooling effectiveness and increases overall cooler size. The application difficulties of Hasanovic's design are similar to that of other compartmented designs which stem from the insulating effect of the walls of the internal enclosure. Though identified as a thermal conduction layer, the walls nevertheless insulate the contents thereby compromising the cooling performance of his design. By comparison, traditional cooler designs achieve the best cooling performance by providing direct contact of the ice and melt water with the contents. Additional problems may arise whenever the inner enclosure is removed and then reset or whenever the need arises to replenish the ice that surrounds it. The bulky, non-compressive nature of ice and the rigidity of both enclosures would likely hinder efforts to reassemble them.

Nelson also details a compartmented cooler with an internal cooler box surrounded by a refrigerant containing enclosure. The surrounding enclosure forms a jacket that contains the refrigerant liquid and allows it to move around the internal cooler box while preventing its entry to the internal cooler. Accessibility of contents and exclusion of moisture appear well achieved but with a larger size and lower cooling performance. The cooling performance of Nelson's design is limited by the absence of an overlying ice layer and the presence of a continuous barrier wall and floor that separate the refrigerating coolant from the cooled items. The manner of replenishing the ice around and below the internal cooler is not detailed. Servicing the coolant appears to be a multi-step process requiring removal and reinsertion of the internal cooler box, with each reinsertion preceded by a targeted placement of ice within the horizontal and vertical voids that surround the internal cooler box.

A simple rigid shelf is detailed by Carlson. The shelf is removable and placed on the bottom of the cooler. A raised platform supports the overlying contents and ice. This design holds the majority of ice and all the contents above the ice melt; however, it offers no solution to enhance accessibility to the contents interspersed within the ice.

Silberman also details a rigid shelf. His design incorporates a height adjustment. Silberman's shelf separates the ice and cooled items above the cooler bottom as a means to separate the ice melt; however, no provision is made to segregate the ice from the cooled items.

A removable adjustable divider is set forth by Wagoner. His design incorporates two larger and two smaller rigid rectangular plastic panels with sliding lockable hinge mechanisms that provide for adaptability of the panels to the dynamic space needs of a cooler. His claims set forth the purpose of separating food items from ice melt. No claim relating to the separation of ice from the cooled items is made. As noted with other designs, the use of barrier walls and adjustable panels also compromises the cooling performance and encumbers the operation of Wagoner's design.

Multiple drawers are set forth by Brown and Starling as well as Shill. Brown and Starling detail a multi-drawer cooler accessible from both the top as well as from multiple drawers on the side of the cooler. The contents are placed on grates immediately above and proximate to a shallow ice layer placed in each drawer. Additional ice storage as well as beverage container storage is built into the periphery of this cooler. Brown and Starling state that the ice does not contact the contents in the drawers, so cooling appears to be by convection only. The provision of multiple externally accessible drawers in addition to a hinged top lid maximizes accessibility; however, the considerable absence of conduction surface area limits the cooling performance of this design. Additionally, replenishing the ice to a uniform level in each of the drawers is time consuming.

Shill's design features a way to keep cooled items dry. Wet compartments partially surround a dry compartment to segregate the ice from the dry cooled contents. Cooling of the dry contents is predominantly by convection air flow from the rear wet compartment which has a perforated wall to enhance the cooling capacity. Access to the wet compartments is from above and access to the dry compartment from the front. Multiple drawers are exclusive to the dry compartment. The wet compartments are individual chambers. A high degree of access to the contents and ice is achieved. Deficiencies of the design seem to be a larger cooler size and a diminished cooling effect to the dry compartment due to an absence of ice above and anterior to the drawers. The dry compartment cooling capacity is further compromised by a reliance on convection cooling which is a consequence of the physical separation of the contents from the ice.

An Invertible cooler design appears exclusive to Redford. Although the ice and contents remain mixed, easy access to the opposing ends of the cooler is facilitated by the invertible design. With repeated usage, the maintenance of leak-proof seals at both access covers seems unlikely. Additionally, the process of repeatedly inverting the cooler to locate an item would likely damage more fragile items as the weight of the ice shifts abruptly from one end of the cooler to the other.

A variety of flexible fabric-based dividers have been detailed. These designs target either the separation of ice from the contents or the melted ice water from the contents and ice. They employ either water-permeable or water-impermeable fabrics configured as vertically removable bags or vertically removable netting that may be used individually or in a plurality. Balleck details two very similar vertically removable netting designs. Both allow for the removal of the entire ice volume from above the cooled items. The netting is permeable to the melt water and conformable to the cooled items. A rim, a bathtub type contour, and a handle are employed. Balleck's design is simple and effective. Functionally, his design appears limited to small coolers due to the weight of ice that the user must manually lift and suspend while accessing the underlying cooled items. Also, the assistance of another person or a hook appears essential to suspend the netting device so that the user's arms may be freed to manipulate the cooled items. Without such a provision, the user is likely forced to set the ice down outside the cooler each time the cooled items are accessed, progressively soiling the ice and cooler.

Byrne details a disposable cooler liner consisting of a water impermeable material with a closure device at the top and potentially multiple separating walls within. Functionally, his design provides separate compartments of fixed sizes that may be dedicated to cooled items, ice, or a combination. The disposable liner is vertically accessed. The fixed dimensions of the separating walls appear to limit their adaptability to varying proportions of cooled items versus ice.

Robinson, Robinson, and DeVries detail a coarse-meshed net that suspends the cooled items while allowing smaller ice cubes and ice melt water to fall beneath the net when it is lifted out of the cooler. Once the ice and ice melt water have migrated through the net, the cooled items are exposed above the ice. To restore optimum cooling performance, a new layer of ice must be applied over the remaining cooled items. Repeated use results in migration of the ice to beneath the cooled items, which reduces the cooling efficiency.

Gonzalez and Smith detail a convertible cooler design that employs multiple plates that form multiple compartments that allow the targeted placement of dry ice to either cool or maintain the items in the cooler in a frozen state. The dry ice is segregated from the cooled items in the compartments by means of apertures through the plates. If dry ice is not required, the plates may be removed and the cooler is converted to an ice-cooled cooler. An additional mesh material appears to facilitate handling of the dry ice and to maintain the segregation of the dry ice from the cooled items. Because dry ice undergoes a phase change directly from a solid to a vapor, wetting of the cooled items does not occur. Segregating the dry ice from the cooled items would serve to protect the user from freeze burns and reduce the incidence of unwanted freezing of the cooled items.

SUMMARY OF THE INVENTION

This new embodiment of a portable ice cooler provides numerous improvements beyond the current state of the art: (A) A simple internal roller mechanism and mesh fabrics are employed to retract the ice from the cooled items. The capacity to retract the ice away from the cooled items prior to their retrieval or replenishment is a distinguishing feature. The perforated, lightweight, and conformable qualities of the mesh fabrics deliver two advantages: (1) they provide a strong, reliable, and compact means to separate the ice and cooled items; and (2) whenever retraction of the ice is not needed, they promote efficient cooling by permitting the ice and cooled items to retain close proximity to one another. (B) Restocking of the cooler can be performed either when it is positioned on its back or when it is upright. Restocking of the cooler with it on its back is the simplest and fastest method because items can simply be dropped inside. (C) A smooth long radius curvature forms the external contour of the cooler where the rear exterior wall transitions to the bottom of the cooler. This curvature eases the movement of the cooler onto its back, which aids restocking. When the cooler is positioned on its back the ice and netting shift down and away from the front door. This movement of the ice and netting provides a full view and unobstructed access to the available storage space which is now directly beneath the bottom-pivoting front door. (D) A front door rather than a top door takes advantage of the ice retraction capability whenever cooled items are removed. Whenever the ice is retracted in preparation for the removal of a cooled item the ice is lifted and a horizontal pathway forms beneath it. This pathway is accessible from the front door but not from a top down approach into the cooler. The combination of these two features significantly eases access to the cooled items. (E) The provision of a window toward the base of the cooler door permits visibility to the front of the cooler and under the retracted ice. (F) Internal LED lighting further enhances visibility.

The advantages these features provide are an unparalleled degree of comfort, speed, and ease of access to the desired items in the cooler. What has characteristically required painful and sometimes extensive hand excavation through the cooler ice without visual or lighted guidance is now poised to become a thing of the past. Furthermore, these advantages are achieved with only a negligible reduction in the storage capacity and cooling efficiency.

There are two main problems with the current state of the art: Compartmentalized coolers are rare and their larger size and reduced cooling efficiency are likely drawbacks that are disfavored by consumers. Alternatively, coolers that are accessed through a top door frequently require the uncomfortable and difficult manual task of moving the ice whenever the contents beneath it are accessed. To locate an unseen item or to reload new items beneath the ice requires an uncomfortable hand foray through the ice layer. Access is further impeded by a downward only line of sight and the absence of built in illumination under the ice. Coolers that are accessed through a top door presumably lack lighting and windows because the overlying and interspersed ice negates any meaningful benefit from illumination.

All of the aforementioned limitations of the prior art are overcome by this new embodiment. The front door, a window, an adjustable means to retract the ice layer, an optimized external contour, and interior lighting, together increase the speed at which cooled items may be visually located and accessed. Retraction of the ice minimizes or eliminates contact of the hands with the ice. Additionally, retraction of the ice and the rolling of the cooler to its back greatly simplify the reloading of the cooler and virtually eliminate the spillage of ice when performing these tasks. The design is simple, compact, and reliable. The sieve size, light gauge, and conformability of the ice-retaining meshes maximize contact of the ice with the contents, thereby minimizing the loss of cooling efficiency.

DRAWING REFERENCE NUMERALS

Figure 1:
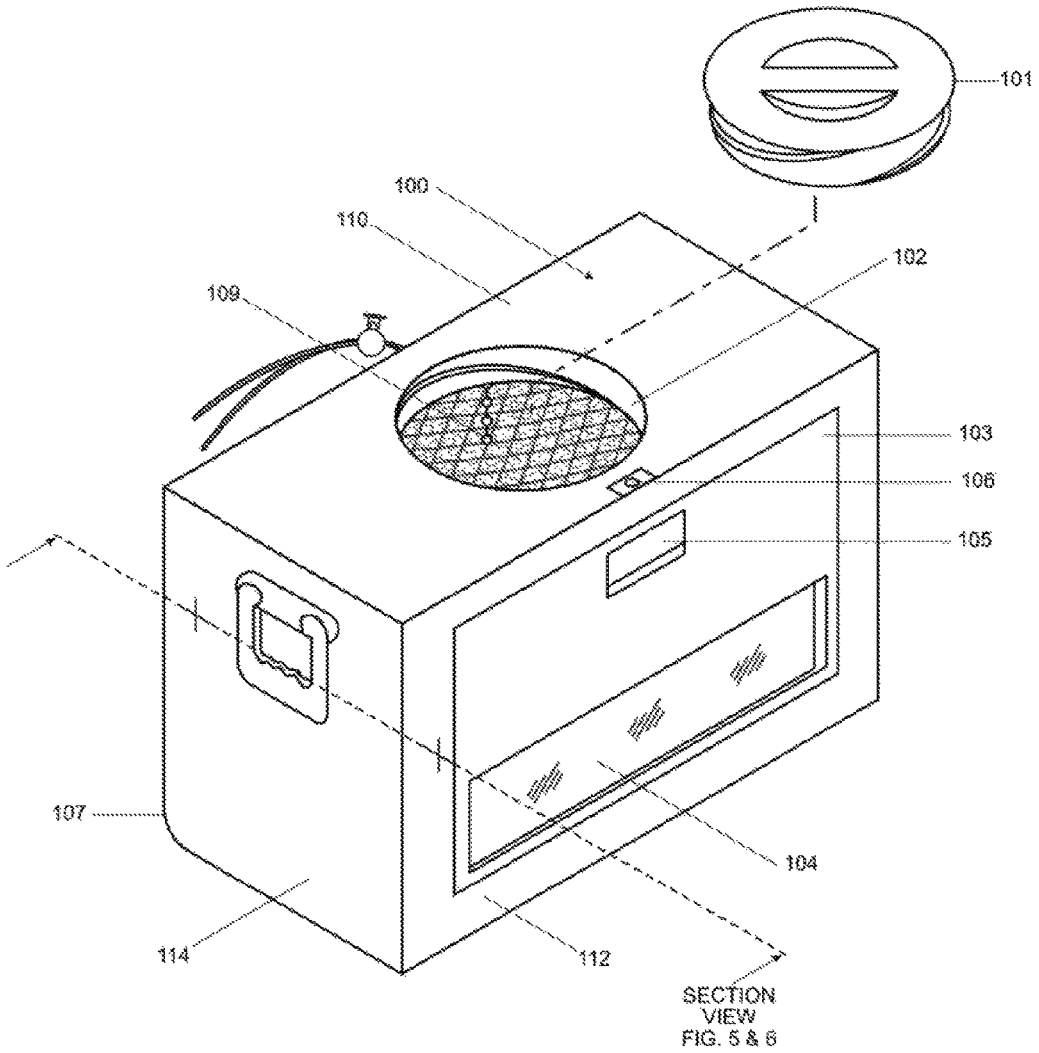
FIG. 1 Retractable Ice Cooler External View—Front 1/6—An oblique front view of the external features with a glimpse inside the top.
Figure 2:
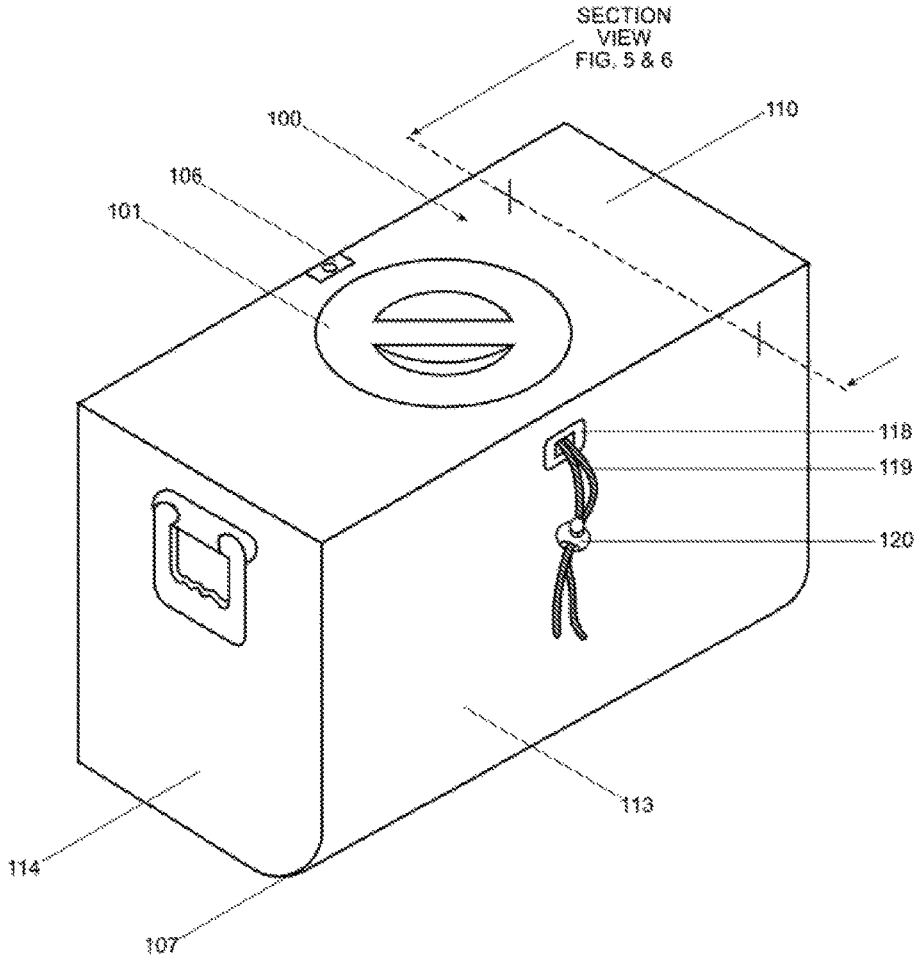
FIG. 2 Retractable Ice Cooler External View—Back 2/6—An oblique back view of the external features.
Figure 3:
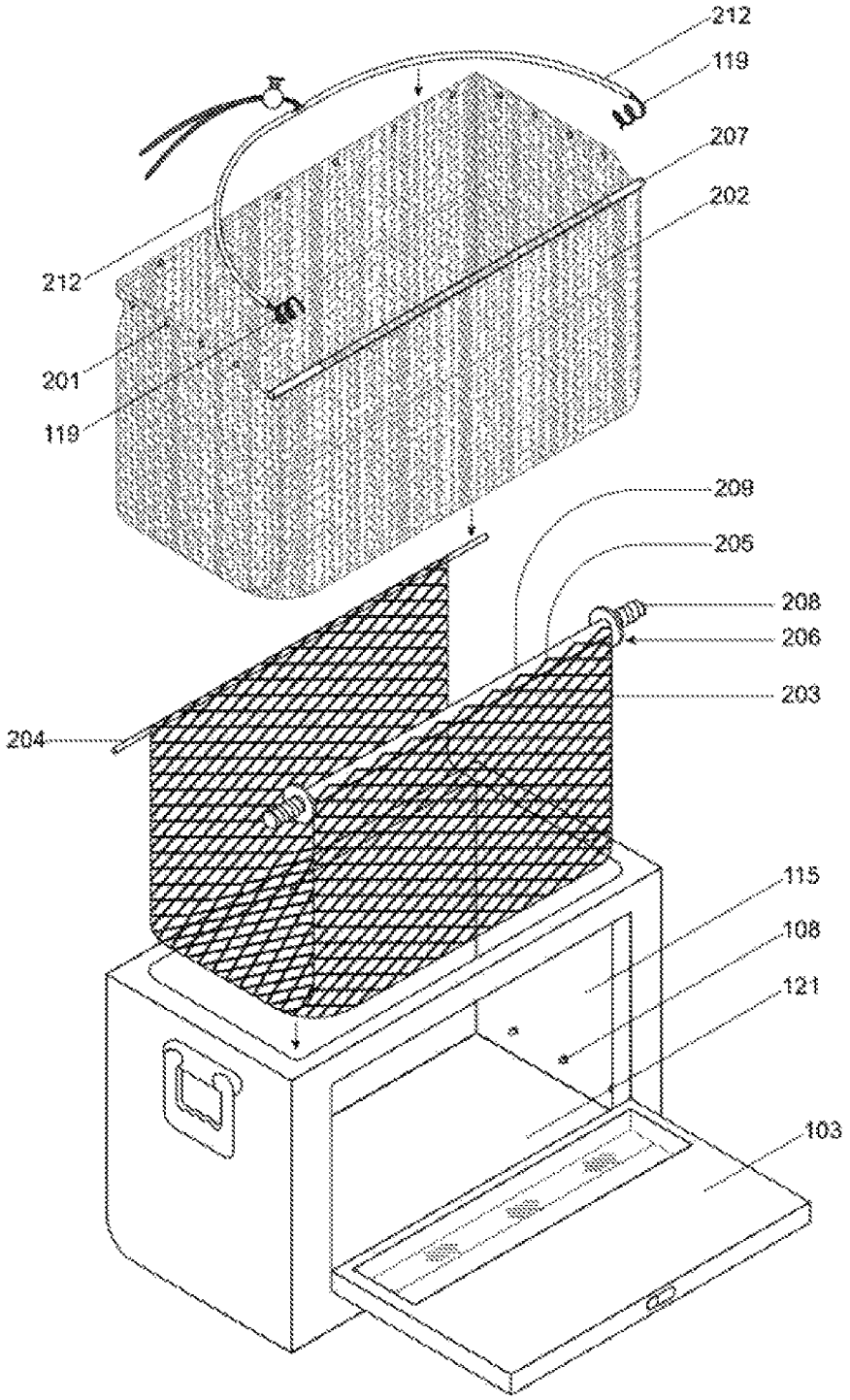
FIG. 3 Retractable Ice Cooler Ice Containment Assembly Subassemblies 3/6—An oblique view of the individual components of the Ice Containment Assembly and their relative position within the cooler. The Cooler top is omitted for clarity.
Figure 4:
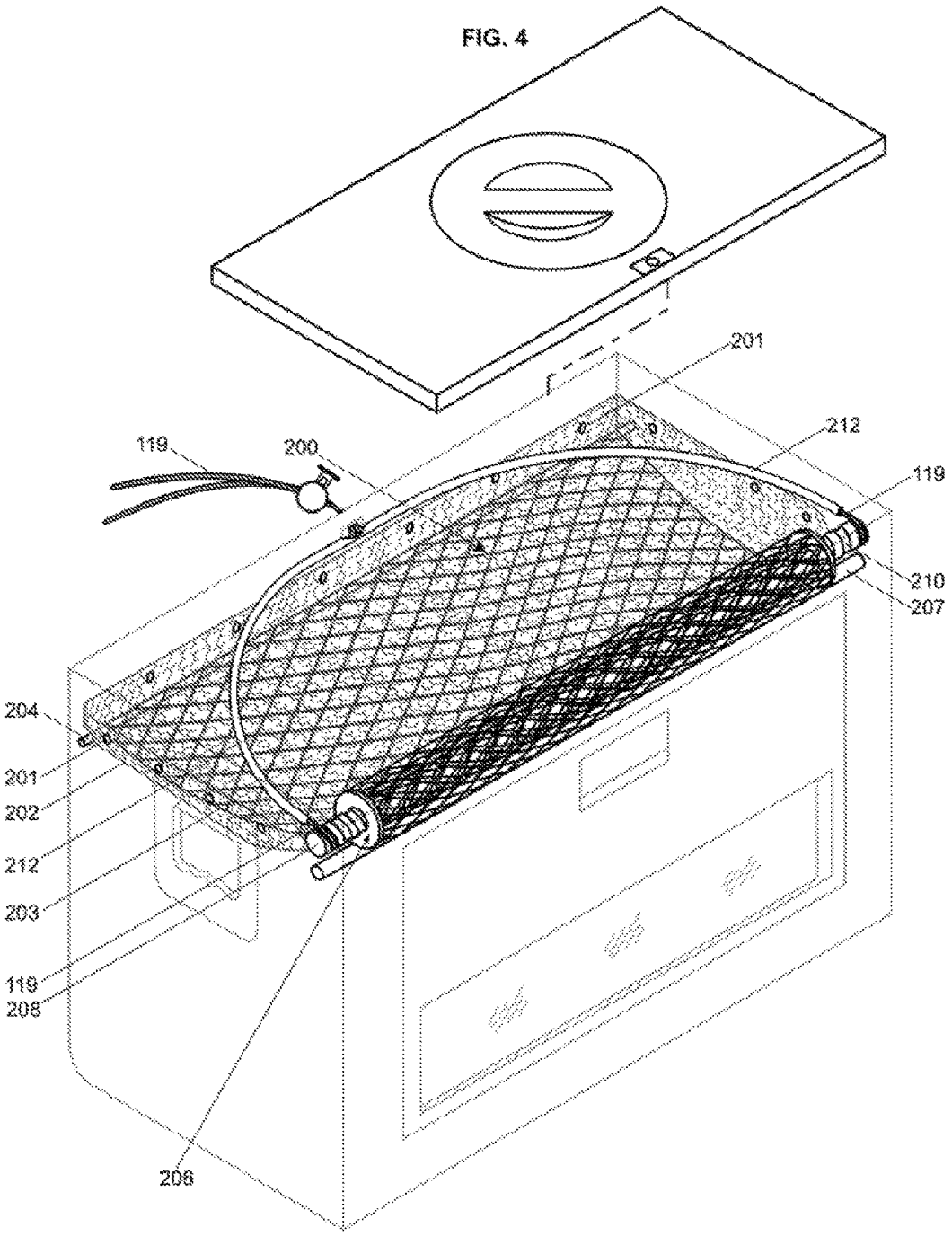
FIG. 4 Retractable Ice Cooler Ice Containment Assembly Retracted 4/6—An oblique view depicting the Ice Containment Assembly in a retracted state with the top of the cooler removed and the ice omitted for clarity.
Figure 5:
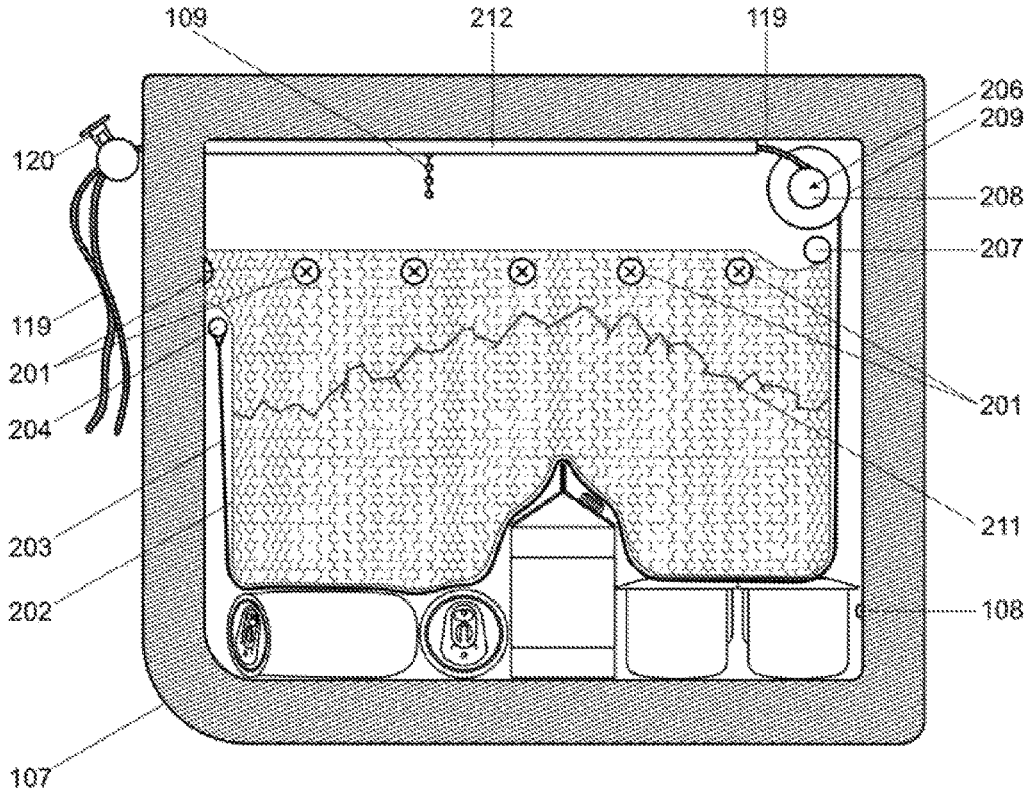
FIG. 5 Retractable Ice Cooler Unretracted Ice Containment Assembly Side View Section 5/6—section view just inside the left lateral wall depicting the relationship of the cooler components with the ice and cooled items.
Figure 6:
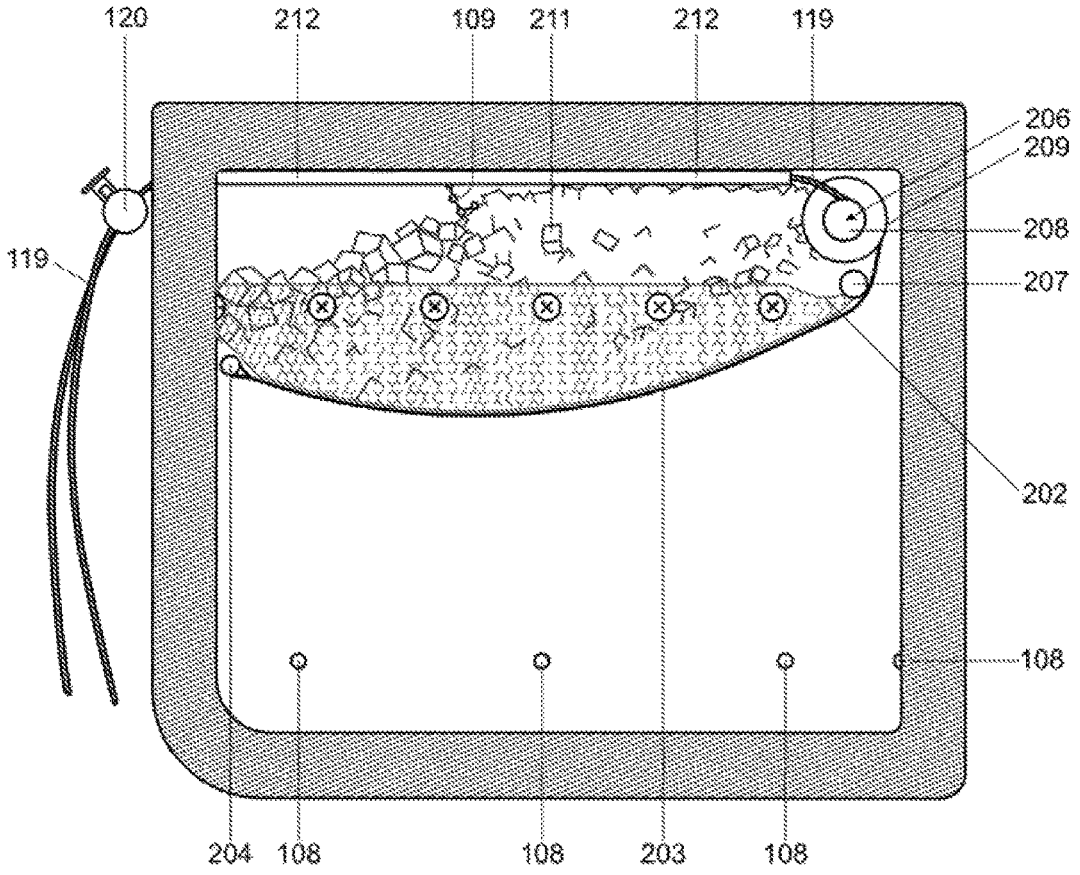
FIG. 6 Retractable Ice Cooler Retracted Ice Containment Assembly Side View Section 6/6—A section view just inside the left lateral wall depicting the relationship of the retracted Ice Containment Assembly to the ice. Cooled items are omitted for clarity.

100 Retractable Ice Cooler
101 Removable Fill Cap
102 Fill Opening
103 Bottom-Pivoting Front Door
104 Window
105 Door Latch
106 Light Switch
107 Loading Curvature
108 LED Lights
109 Fill Level Indicator
110 Top
111 Bottom
112 Front
113 Back
114 Lateral Side(s)
115 Lateral Inside Wall
116 Back Inside Wall
117 Front Inside Wall
118 Drawstring Opening
119 Color Coded Drawstring(s)
120 Cord Lock -continued 121 Cooler Floor
200 Ice Containment Assembly
201 Small Sieve Mesh Fabric Anchor(s)
202 Small Sieve Mesh Fabric
203 Large Sieve Mesh Fabric
204 Large Sieve Mesh Fabric Anchor Bar
205 Large Sieve Mesh Fabric Terminal End
206 Large Sieve Mesh Fabric Retraction Roller
207 Small Sieve Mesh Fabric Ice Retention Bar
208 Dual Small Diameter Spool
209 Single Large Diameter Spool
210 Recessed Spiral Groove(s)
211 Ice
212 Drawstring Guide Raceway(s)

DETAILED DESCRIPTION—FIRST EMBODIMENT

FIG. 1, 2, 3

The process of making the Retractable Ice Cooler 100 involves molding a thermally insulated plastic cooler typically in a cube or rectangular shape. The Cooler 100 is constructed such that it has a Removable Fill Cap 101, a Fill Opening 102 and a single Bottom-Pivoting Front Door 103. The Top 110 of the Cooler 100 is typically a flat surface continuously molded with the adjacent vertical sides of the cooler. The Removable Fill Cap 101 is a circular threaded and thermally insulated removable cap of a predetermined diameter suitable for the placement of Ice 211 into the Cooler 100. Inside the Cooler 100 immediately adjacent to the Fill Opening 102 is a Fill Level Indicator 109. The Fill Level Indicator 109 suspends from the inside Top 110 of the Cooler 100. The Indicator 109 is a high visibility, flexible, weighted, beaded line similar to a pull chain for a light. The suspended end of the Indicator 109 serves as a visual cue of the maximum depth to which Ice 211 may be placed in the Cooler 100 without hindering the performance of the Ice Containment Assembly 200.

The Bottom-Pivoting Front Door 103 is positioned on the Front 112 of the Cooler 100. This Door 103 has a Door Latch 105 at its top and it closes flush with the adjacent surfaces of the Cooler 100. The bottom of the Door 103 is positioned above the base of the Cooler 100 at a sufficient distance to minimize the potential for accumulated melt water to leak from the opening. When opened fully, the Door 103 pivots down greater than 90° degrees. The Door 103 is large and intended for the placement and removal of items stored in the cooler. The Door 103 is typically made of opaque materials although may be constructed to integrate a horizontal rectangular tempered glass (or other impact-resistant and abrasion-resistant transparent material) to form a Window 104. The Window 104 material would typically be a double wall design with a sealed internal vacuum space to maintain thermal efficiency. This Window 104 aids locating items within the cooler.

On the Top 110 of the Cooler 100 above the Front Door 103 is a three-way push-button Light Switch 106 mounted flush with the Cooler 100 surface. This Switch 106 may be set to Off, On, or Auto, and it operates multiple LED lights 108 embedded in the Front Inside Wall 116 and Lateral Inside Walls 115 of the Cooler 100.

The Back 113 of the Cooler 100 is formed by a molded vertical wall which employs a long radius Loading Curvature 107 which forms the transition to the Bottom of the Cooler 111. This Curvature 107 exists to ease rolling the Cooler 100 onto its Back 113 which facilitates the stocking of the Cooler 100 with items to be cooled. Near the top center of the Back 113 of the Cooler 100, a small Drawstring Opening 118 forms an outlet passage through which two Color Coded Drawstrings 119 are routed. A single Cord Lock 120 couples the Drawstrings 119.

FIG. 3, 4, 5, 6

Inside the Retractable Ice Cooler 100 resides the Ice Containment Assembly 200 which separates the Cooler 100 into two distinct spaces. The volume of these spaces is adjustable and their movable boundary is defined by the position of two layered mesh fabrics. A Small Sieve Mesh Fabric 202 which consists of a strong 4-way stretchable, smooth nylon (or similar webbed mesh) forms the top layer. The sieve size of this Mesh 202 is generally pea-sized or smaller. The Mesh 202 is anchored directly to both Lateral Inside Walls 115 and the Back Inside Wall 116. The front portion of the Mesh 202 is anchored to a rigid horizontal bar that extends the width of the cooler and resides immediately above the Bottom-Pivoting Front Door 103. These four anchor points promote a bathtub configuration of the Mesh 202.

The rigid horizontal bar that anchors the Small Sieve Mesh Fabric 202 at the Front 112 of the Cooler 100 is the Small Sieve Mesh Fabric Ice Retention Bar 207. The Small Sieve Mesh Fabric Ice Retention Bar 207 is fixed parallel to the front wall of the Cooler 100 but does not contact it. The Retention Bar 207 and the attached Small Mesh 202 form one side of a narrow horizontal gap. The opposing side is formed by the Front Inside Wall 117 of the Cooler 100. This horizontal gap is utilized as a track through which the second underlying mesh called the Large Sieve Mesh Fabric 203 is periodically moved.

The Large Sieve Mesh Fabric 203 is a minimal stretch high-strength nylon (or similar mesh) with a sieve opening generally equivalent to a typical ice cube. This Large Sieve Mesh Fabric 203 is ideally configured as a molded-flat webbing such that it is substantially wider than it is thick. This flat configuration provides essential qualities of horizontal rigidity, conformability under vertical loads, ease of application to a roller, and a reduced potential to snag. The Large Mesh 203 is sized to match the width of the Cooler 100 and approximately half the length of the internal circumference of the Cooler 100 when measured from the Front Inside Wall 117 to the Back Inside Wall 116. The Large Mesh 203 is secured against the Back Inside Wall 116 by the Large Sieve Mesh Fabric Anchor Bar 204. The Large Sieve Mesh Fabric Anchor Bar 204 inserts at its opposite ends into each Lateral Inside Wall 115 at a level just below the row of Small Sieve Mesh Fabric Anchors 201. The Anchor Bar 204 maintains one end of the Large Mesh 203 in a horizontal plane abutting the Back Inside Wall 116. The Large Mesh 203 extends from the Back Inside Wall 116 across the Cooler Floor 121, loosely following the interior contour to the top of the Front Inside Wall 117. When unretracted the Large Mesh 203 resides entirely beneath the Small Mesh 202.

The unanchored end of the Large Sieve Mesh Fabric 203 that extends up the Front Inside Wall 117 is referred to as the Large Sieve Mesh Fabric Terminal End 205. Near the top of the Front Inside Wall 117, the Terminal End 205 is routed upward through the narrow horizontal gap between the Front Inside Wall 117 and the Small Sieve Mesh Fabric Ice Retention Bar 207. Above this point, the Terminal End 205 is anchored along its entire width to the Large Sieve Mesh Fabric Retraction Roller 206. The Large Sieve Mesh Fabric Retraction Roller 206 is controlled by two Color Coded Drawstrings 119.

The Large Sieve Mesh Fabric Retraction Roller 206 inserts at both ends near the top of each Lateral Inside Wall 115 adjacent to the Front Inside Wall 117 above the Bottom-Pivoting Front Door 103. The Retraction Roller 206 is constructed with two distinct diameters. Dual Small Diameter Spools 208 comprise the opposing ends of the Retraction Roller 206 and are separated by a single Large Diameter Spool 209. Each Small Diameter Spool 208 has a Recessed Spiral Groove 210 formed into it in which each Color Coded Drawstring 119 is alternately wound and unwound. The Single Large Diameter Spool 209 forms a roller upon which the Large Sieve Mesh Fabric 203 is alternately wrapped and unwrapped. The difference in the diameter of the Dual Small Diameter Spools 208 and that of the Single Large Diameter Spool 209 functions to increase the speed at which the Mesh 203 is wrapped upon the Large Diameter Spool 209. The Dual Small Diameter Spools 208 and integrated Recessed Spiral Grooves 210 form a compact and tangle-resistant drive mechanism for the Ice Containment Assembly 200.

The Color Coded Drawstrings 119 are envisioned to comprise two small diameter, low-stretch, and high strength cords. The Drawstrings 119 individually insert into each of the Recessed Spiral Grooves 210 formed in the Dual Small Diameter Spools 208 of the Large Sieve Mesh Fabric Retraction Roller 206. The Drawstrings 119 are coiled individually within their respective Spiral Groove 210 and then extend diagonally away from the Dual Small Diameter Spools 208. Each Drawstring 119 then suspends unsupported for a short distance before it enters a close fitting rigid tubular structure called a Drawstring Guide Raceway 212. The Drawstring Guide Raceway's 212 are two fixed tubular pathways. The Raceways 212 route their respective Drawstring 119 from its respective Recessed Spiral Groove 210 across the top of the Cooler 100 interior to the Drawstring Opening 118. The Drawstring Opening 118 forms a common exit point on the Back 113 of the Cooler 100. The path of each Raceway 212 is configured to prevent obstruction of the Ice 211 when it is retracted within or poured into the Cooler 100. Each Raceway 212 aligns the pull of the Drawstrings 119 with their respective Spiral Groove 210. This alignment of pull provides for smooth retraction of the ice. The close fit of the Drawstrings 119 in the Raceways 212 prevent the formation of slack thereby minimizing the potential for each Drawstring 119 to tangle upon itself. Each Color Coded Drawstring 119 has a color sequence that progresses from green to yellow to red. This color progression becomes visible as the Drawstrings 119 are drawn out of the Cooler 100.

OPERATION

FIG. 4, 5, 6

The manner and process of using the Retractable Ice Cooler 100 begins with releasing all tension from the Color Coded Drawstrings 119. This is accomplished by sliding the Cord Lock 120 toward the exposed ends of the Drawstrings 119. The Cooler 100 may then be rolled on its Back 113 to load it vertically, or it may remain in the upright position to load it horizontally. When the Cooler 100 is rolled on its Back 113, the Bottom-Pivoting Front Door 103 is located at the top part of the Cooler 100. The Door 103 can then be opened beyond 90° degrees where it will stay open and not obstruct the placement of cooled items into the bottom of the Cooler 100. When the Cooler 100 is on its back, the Large and Small Sieve Mesh Fabrics 202 and 203 move under their own weight toward the Top 110 and Back 116 inside walls. This movement exposes the space normally covered by the Mesh Fabrics 202 and 203 which is available for loading of cooled items. When the contents have been loaded the Door 103 can then be latched shut. The Cooler 100 can then be rolled upright and the Removable Fill Cap 101 removed. Ice 211 is then poured into the Fill Opening 102 until the Ice 211 has covered the cooled items and displaced the Fill Level Indicator 109. The Removable Fill Cap 101 is then reinserted. As the Ice 211 fills the Cooler 100 the weight of the Ice 211 causes the Small and Large Sieve Mesh Fabrics 202 and 203 to conform to the contents loaded into the Cooler 100. The Cooler 100 may then be rocked back and forth to maximize the leveling and coverage of the ice over the contents. The automatic setting for the Light Switch 106 is then set. The Cooler 100 is now ready for operation.

When retrieval of an item from the Cooler 100 is necessary it may be achieved in one of three ways. In the first and simplest method retrieval involves opening the Front Door 103 by means of releasing the Door Latch 105 and allowing the Door 103 to extend to a fully opened position. As the Door 103 is opened the LED Lights 108 are energized and they illuminate the lower interior of the Cooler 100. Retrieval of visible items may then be performed by simply reaching under or in front of the Mesh layers 202 and 203 to grasp the desired item.

A second method of item retrieval may be performed by placing the Cooler 100 onto its Back 113. This rotating action allows a portion of the Ice 211 to shift off of the contents. The rotational effect further causes the Ice 211 to push the cooled items located toward the Front Inside Wall 117 of the Cooler 100 upward. This motion helps expose the items and eases their retrieval through the Bottom-Pivoting Front Door 103.

The third method of item retrieval is performed with the Cooler 100 in an upright position. This method is useful when the desired item is not visible or easily grasped due to its size or encapsulation by the ice 211 and it's supporting Mesh layers 202 and 203. The Bottom-Pivoting Front Door 103 may be opened before or after the following steps. Retrieval begins by grasping the Color Coded Drawstrings 119 and briskly retracting them from the Cooler 100 while the opposite hand applies an equivalent downward pressure on the Top 110 of the Cooler 100 above the Door 103. The effect of these actions is to turn the Large Sieve Mesh Fabric Retraction Roller 206 so that it applies tension to the Large Sieve Mesh Fabric 203 and rolls it up onto the Single Large Diameter Spool 209. The rolling of the Large Mesh 203 upon the Spool 209 provides a progressive upward lift of the entire volume of Ice 211 into the top portion of the Cooler 100. The more the Drawstrings 119 are retracted from the Cooler 100 the greater the retraction and resultant lift that occurs to the Ice 211. The forceful retraction of the Ice 211 breaks up obstructive clumps of ice that frequently form. The Color Coded Drawstrings 119 incorporate a visual indicator of the extent of retraction applied to the Ice 211. As the Drawstrings 119 are progressively withdrawn from the Cooler 100 their color changes from green to yellow to red. This color progression informs the user of the safe range of retraction available.

Retraction of the Ice 211 may be momentary or sustained. The Cord Lock 120 may be slid up the Drawstrings 119 to the edge of the Cooler 100 and locked in place when sustained retraction of the Ice 211 is desired. Sustained retraction of the Ice 211 is a desirable condition foreseeable when reloading the cooler contents, when frequent access is required, or when the weight of the ice may be injurious to the contents.

When the desired contents have been removed from the Cooler 100 the Door 103 is closed and the Cord Lock 120 is released. Releasing the Cord Lock 120 restores the optimum cooling environment inside the Cooler 100 by allowing the retracted Ice 211 and underlying Mesh Fabrics 202 and 203 to collapse downward under the weight of the Ice 211 onto and conforming over the contents. Releasing the Cord Lock 120 also restores the maximum space available for Ice 211.

CONCLUSIONS, RAMIFICATIONS AND SCOPE

Thus, the reader will observe that the embodiment of the Retractable Ice Cooler improves the convenience and usefulness of an ice cooler. While the preceding description details multiple specificities these should not be interpreted as limitations to the scope of application. Rather, they serve to illustrate by example one possible embodiment. Additional variants are possible and could include a power-assisted roller to reduce or eliminate the manual effort necessary to retract the ice. A battery-operated apparatus, much like the drive mechanism that commonly operates an electric car window is envisioned. Exchanging the loose hanging Cord Lock ice retraction adjustment mechanism with a fixed position recessed locking cleat (similar to those used in sailboat deck rigging) would streamline the cooler appearance and enhance the durability of the ice retraction adjustment mechanism. Changes in the component materials are also possible and might include an integrated fabric mesh that combines the small sieve and large sieve qualities in one latticed fabric. Accordingly, the scope should not be limited to the embodiment detailed herein, but by the claims and their legal equivalents.

I claim:

1. A thermally insulated ice cooler comprising:

a front side; a back side; two lateral sides; and a bottom side, each of said front side, back side, two lateral sides, and bottom side having an interior surface which together form an interior space of said ice cooler;

an upper ice containment layer disposed within said interior space and having an upper portion affixed to at least said interior surfaces of each of said two lateral sides of said ice cooler; and a retractable lower containment layer mounted within said interior space and having a lower portion nested below and contacting a lower portion of said upper ice containment layer;

wherein said lower containment layer is configured to be retractable by a user to lift at least said lower portion of said upper ice containment layer;

wherein, when said lower containment layer is unretracted, said lower portion of said upper ice containment layer and said lower portion of said lower containment layer are configured to be conformable to contents of the ice cooler resting on the interior surface of said bottom side of said ice cooler, wherein one end of said retractable lower containment layer is affixed to an anchor bar located adjacent to the interior surface of said back side of said ice cooler, said anchor bar having a first end and a second end, said first end of said anchor bar secured within the interior surface of one of said two lateral sides of said ice cooler, said second end of said anchor bar secured within the interior surface of the other of said two lateral sides of said ice cooler, and wherein a second end of said retractable lower containment layer is affixed to a roller that is configured to apply tension to said retractable lower containment layer so as to retract said retractable lower containment layer to lift said upper ice containment layer and any ice resting on said upper ice containment layer.

2. The thermally insulated ice cooler of claim 1 wherein said upper ice containment layer comprises a mesh fabric.

3. The thermally insulated ice cooler of claim 1, wherein a door is disposed within a portion of said front side of said ice cooler.

4. The thermally insulated ice cooler of claim 1, further comprising a top side having an interior surface to which a fill level indicator is secured.

5. The thermally insulated ice cooler of claim 1 wherein said retractable lower containment layer is retractable by at least one drawstring.

6. The thermally insulated ice cooler of claim 5 wherein a cord lock is fastened to said drawstring to secure said lower retractable containment layer in a specific position with respect to said upper ice containment layer.

* * * * *